US007188576B2

(12) United States Patent
Bogard et al.

(10) Patent No.: US 7,188,576 B2
(45) Date of Patent: Mar. 13, 2007

(54) MODULAR DECK STRUCTURE OF A PONTOON BOAT

(75) Inventors: Jeff Bogard, Hot Springs, AR (US); David Ashcraft, Sr., Hot Springs, AR (US)

(73) Assignee: Xpress Boats, Hot Springs, AR (US)

( * ) Notice: Subject to any disclaimer, the term of this patent is extended or adjusted under 35 U.S.C. 154(b) by 301 days.

(21) Appl. No.: 10/901,483

(22) Filed: Jul. 29, 2004

(65) Prior Publication Data

US 2006/0021561 A1 Feb. 2, 2006

(51) Int. Cl.
*B63B 3/48* (2006.01)
*B63B 5/06* (2006.01)
*B63B 35/34* (2006.01)

(52) U.S. Cl. ..... 114/85; 114/61.1; 114/266

(58) Field of Classification Search ..... 114/85, 114/263, 264, 265, 266, 267, 61.1, 61.22, 114/355, 356; 52/574, 588.1, 579, 584.1, 52/592.1
See application file for complete search history.

(56) References Cited

U.S. PATENT DOCUMENTS 3,100,556 A * 8/1963 De Ridder ..... 52/588.1
3,301,147 A * 1/1967 Clayton et al. ..... 404/35
3,385,182 A * 5/1968 Harvey ..... 404/35
5,050,361 A * 9/1991 Hallsten ..... 52/581
5,758,467 A * 6/1998 Snear et al. ..... 52/592.1
5,816,010 A * 10/1998 Conn ..... 52/588.1
5,819,491 A * 10/1998 Davis ..... 52/592.1
6,199,340 B1 * 3/2001 Davis ..... 52/592.1
6,324,796 B1 * 12/2001 Heath ..... 52/177
6,637,163 B2 * 10/2003 Thibault et al. ..... 52/177
6,918,221 B2 * 7/2005 Williams ..... 52/592.1
7,021,012 B2 * 4/2006 Zeng et al. ..... 52/177
7,047,697 B1 * 5/2006 Heath ..... 52/177

* cited by examiner

*Primary Examiner*—Ajay Vasudeva
(74) *Attorney, Agent, or Firm*—Nathan Price Chaney; Mark Murphey Henry

(57) ABSTRACT

A modular snap-tight interlocking deck and process for constructing a pontoon boat with said deck is described. The modular deck includes lightweight planks that snap together using a tongue-in-groove design. Once joined, the planks are inseparable and form a rigid, flat, watertight surface.

2 Claims, 3 Drawing Sheets

MODULAR DECK STRUCTURE OF A PONTOON BOAT

BACKGROUND OF THE INVENTION

This invention relates generally to modular, watertight decks and more specifically to modular decks for pontoon boats.

Typical pontoon boats have two long pontoons, on top of which a deck is overlaid. The deck is usually constructed of marine-grade plywood and is attached to the pontoons using a Z- or C-bar frame, the latter being the current preferred method. The plywood deck design suffers from several deficiencies. Plywood decks require wave shields to lessen upward seepage through the seams of the deck. Such seepage causes wet spots on the carpeted floors of pontoon boats and wood rot, and the wave shield adds weight to the boat. The invention solves the seepage problem by creating a watertight deck and eliminates the need for a wave shield.

Another deficiency in plywood-decked pontoon boats is the flex at the frame mounting points when the boat is moving through rough water. Said flex causes the pontoons to deviate from the desired parallel pontoon track. The structural rigidity provided by the invention dictates that the pontoons maintain a parallel track even in rough water.

Because a plywood deck requires a frame, the deck height of a boat with such a frame is higher than the deck height of a boat with the deck herein disclosed. The consequences of a lower deck are a lower center of gravity. For pontoon boats, a lower center of gravity results in better planing characteristics. In addition to deck height, the weight savings of an extruded metal deck (22% for the preferred embodiment that uses aluminum) also increases boat performance.

Finally, the assembly of pontoon boats using the disclosed invention rather than plywood decks is easier and faster, thus requiring less labor than traditional methods of pontoon boat construction.

SUMMARY OF THE INVENTION

Bearing the deficiencies of the prior art in mind, it is the object of the invention to provide a lightweight, modular, rigid, and strong deck that is easy to manufacture and assemble.

A number of planks are snapped together using tongue-in-groove connectors on each side of the plank to form a deck of a selected length. Once the deck has reached the desired size, it is squared and spot-welded on the sides of the planks at the seams between adjoining planks. Such welding ensures that the deck remains square because the planks have a slight amount of play when snapped together.

Once the deck is assembled, it is attached to a structure of choice, the preferred embodiment being a plurality of pontoons. In said preferred embodiment, the deck is welded to the pontoons using angle brackets, although a variety of other methods are contemplated. The preferred embodiment uses at least four welds per plank, on either seam where the plank interlocks with two other planks, to ensure structural rigidity. These welds are the same welds used to attach the deck to the pontoons, thus they serve the dual purpose of attachment and strength.

DETAILED DESCRIPTION OF THE PREFERRED EMBODIMENT

Figure 1:
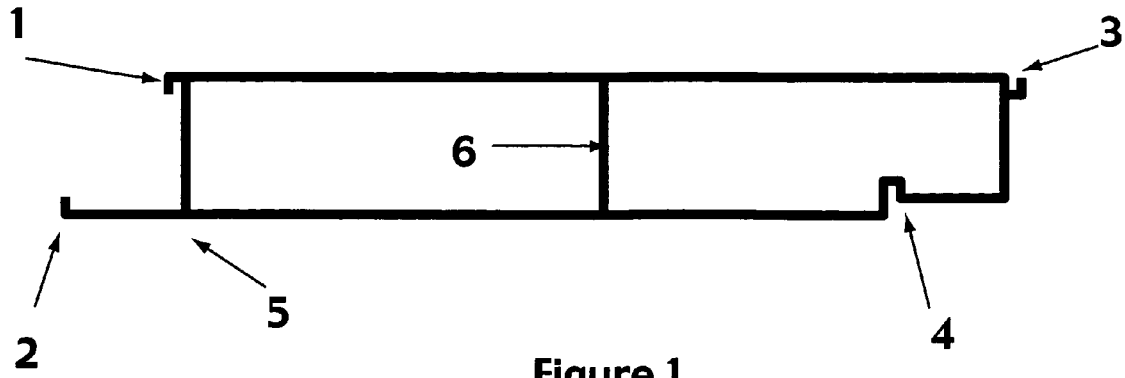
FIG. 1 is a side view of a single plank used in the construction of the interlocking deck according to the present invention.

Referring now to the drawings, like referenced numerals are used to identify identical components in the various figures.

Referring now to FIG. 1, a plank that snaps together with other planks may be used for any purpose that requires a rigid, lightweight, flat deck whose size is determined by the size and number of planks used. In the preferred embodiment, tongues 1 and 2 snap into grooves 3 and 4. It is preferred that the plank has internal structural support, as shown in the present invention by perpendicular support 6. The preferred composition of the plank in FIG. 1 is extruded aluminum, although any lightweight material capable of the rigidity necessary to make adjoining planks inseparable would suffice.

Figure 2:
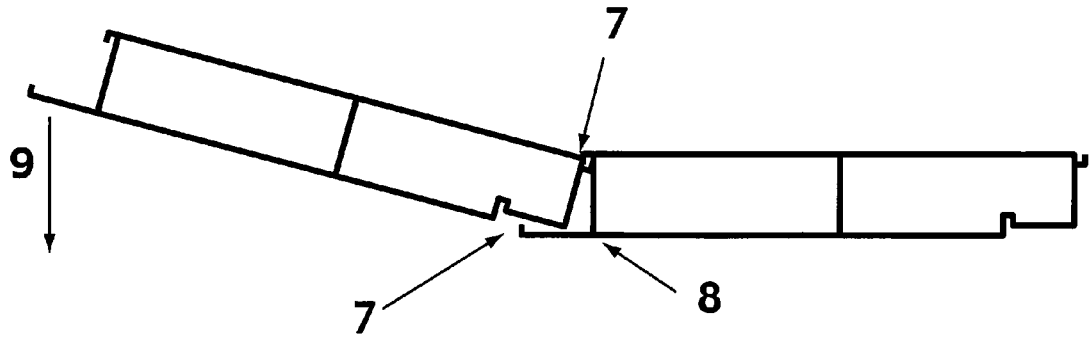
FIG. 2 is a side view showing the process by which two adjoining planks are snapped together according to the present invention.

Referring now to FIG. 2, generally tongue-in-groove connectors 7 are used to secure adjoining planks by applying pressure 9 toward ninety-degree bend 8 in the tongue-and-groove connector 7.

Figure 3:
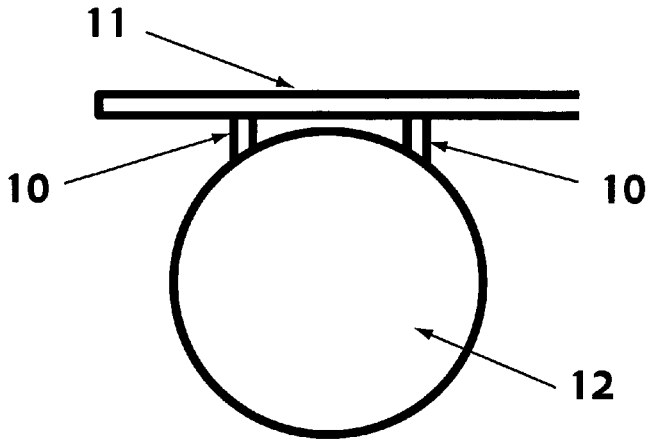
FIG. 3 is a front or rear view showing a pontoon attached to the deck according to the present invention.

Referring now to FIG. 3, the preferred embodiment for constructing a pontoon boat is to attach deck 11 composed of interlocking planks to pontoon 12 using angle brackets 10. Other contemplated methods of attaching pontoon 12 to deck 11 include using a pontoon with flat surfaces capable of being directly welded to the deck.

Figure 4:
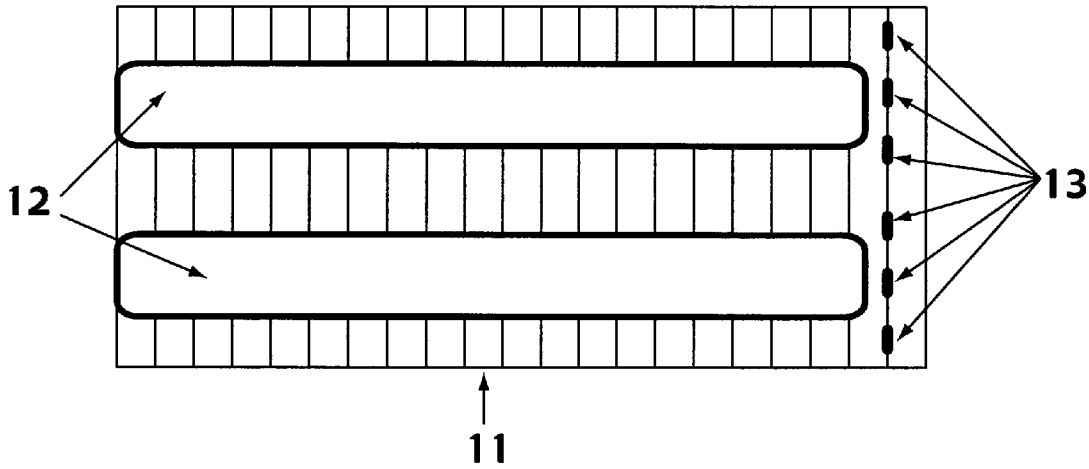
FIG. 4 is a bottom-view-showing pontoons attached to the deck and showing structural welds according to the present invention.

Referring now to FIG. 4, the preferred embodiment for constructing a pontoon boat is to attach deck 11 to pontoon 12 so that a portion of the deck extends beyond the ends of the pontoon. The deck 11 portion that overhangs the pontoons receives welds 13 to increase the structural rigidity of said portion of the deck.

Figure 5:
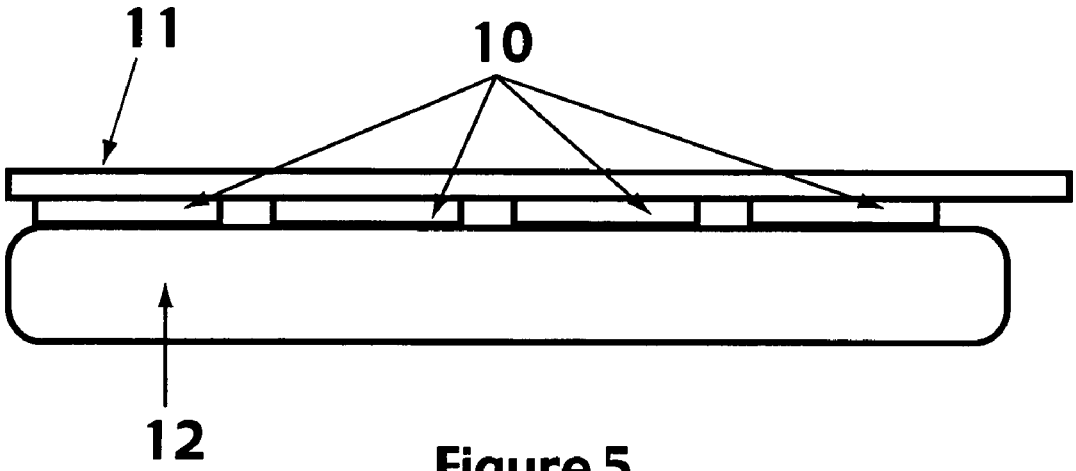
FIG. 5 is a side view showing a pontoon attached to the deck according to the present invention.

Referring now to FIG. 5, the preferred embodiment for constructing a pontoon boat is to attach deck 11 composed of interlocking planks to pontoon 12 using angle brackets 10. Other contemplated methods of attaching pontoon 12 to deck 11 include using a pontoon with flat surfaces capable of being directly welded to the deck.

While the best mode for the current invention has been disclosed here above in detail, persons having ordinary skill in the art will recognize various embodiments for practicing the invention as disclosed in the claims.

The invention claimed is:

1. A method of assembling and attaching a deck to a plurality of pontoons, comprising:

a. snapping together a plurality of planks to assemble the deck, wherein a first plank has a flat top and bottom; wherein one side of the first plank has an L-shaped connector piece with a tongue on the end of the L-shaped connector piece; wherein the opposite side of the first plank has a groove for locking the tongue of an identical adjoining plank; wherein the first plank and the identical adjoining plank are snapped together by inserting the tongue of the first plank into the groove of the adjoining plank and applying a force toward the 90-degree bend of the L-shaped connector; and wherein a plurality of identical adjoining planks are snapped together in like fashion;

b. Spot-welding seams between adjoining planks to ensure that each plank is square with respect to other planks;

c. Welding a plurality of pontoons to a plurality of angle brackets spaced along the length of the pontoon;

d. Welding the angle brackets to the deck at seams between the adjoining planks of the deck;

e. Welding portions of the deck that overhang the pontoon;

f. Welding the deck such that each plank of the deck has a plurality of welds securing the plank to adjoining planks.

2. A method of assembling and attaching a deck to a plurality of pontoons by:

a. snapping together a plurality of planks to assemble the deck, wherein a first plank has a flat top and bottom; wherein one side of the first plank has an L-shaped connector piece with a tongue on the end of the L-shaped connector piece; wherein the opposite side of the first plank has a groove for locking the tongue of an identical adjoining plank; wherein the first plank and the identical adjoining plank are snapped together by inserting the tongue of the first plank into the groove of the adjoining plank and applying a force toward the 90-degree bend of the L-shaped connector; and wherein a plurality of identical adjoining planks are snapped together in like fashion;

b. Spot-welding seams along individual adjoining planks to ensure that each plank is square with respect to other planks;

c. Welding a plurality of pontoons to the deck at seams between the adjoining planks of the deck;

d. Welding portions of the deck that overhang the pontoon;

e. Welding the deck such that each plank of the deck has a plurality of welds securing the plank to adjoining planks.

* * * * *